US011462820B2

(12) United States Patent
Cheng et al.

(10) Patent No.: US 11,462,820 B2
(45) Date of Patent: Oct. 4, 2022

(54) MULTI-BAND BASE STATION ANTENNA FOR SCATTERING SUPPRESSION

(71) Applicant: Hangzhou Dianzi University, Hangzhou (CN)

(72) Inventors: Zhiqun Cheng, Hangzhou (CN); Peng Gao, Hangzhou (CN); Ruoyu He, Hangzhou (CN); Zhen Wang, Hangzhou (CN)

(73) Assignee: Hangzhou Dianzi University, Hangzhou (CN)

( * ) Notice: Subject to any disclaimer, the term of this patent is extended or adjusted under 35 U.S.C. 154(b) by 0 days.

(21) Appl. No.: 17/381,604

(22) Filed: Jul. 21, 2021

(65) Prior Publication Data

US 2022/0149507 A1 May 12, 2022

(30) Foreign Application Priority Data

Nov. 12, 2020 (CN) ..... 202011263897.9

(51) Int. Cl.

| | |
|---|---|
| ***H01Q 21/26*** | (2006.01) |
| ***H01Q 1/24*** | (2006.01) |
| ***H01Q 5/307*** | (2015.01) |
| *H01Q 5/48* | (2015.01) |
| *H01Q 15/14* | (2006.01) |
| *H01Q 21/24* | (2006.01) |

(52) U.S. Cl.

CPC ..... *H01Q 1/246* (2013.01); *H01Q 5/307* (2015.01); *H01Q 21/26* (2013.01); *H01Q 5/48* (2015.01); *H01Q 15/14* (2013.01); *H01Q 21/24* (2013.01)

(58) Field of Classification Search

CPC ..... H01Q 1/246; H01Q 5/307; H01Q 21/26; H01Q 5/48; H01Q 15/14; H01Q 9/16; H01Q 21/24

See application file for complete search history.

(56) References Cited

U.S. PATENT DOCUMENTS

2020/0076079 A1* 3/2020 Shan ..... H01Q 15/14

* cited by examiner

*Primary Examiner* — Joseph J Lauture

(74) *Attorney, Agent, or Firm* — M&B IP Analysts, LLC

(57) ABSTRACT

The present disclosure provides a multi-band base station antenna for scattering suppression, including a high-band dual-polarized antenna and a low-band dual-polarized antenna. The operating band of the high-band dual-polarized antenna is 1.7-3.0 GHz, which are four; the operating band of the low-band dual-polarized antenna operates is 0.69-0.96 GHz, and is comprised of two intersected dipoles; above the high-band dual-polarized antennas, a spacing between the high-band dual-polarized antenna and the low-band dual-polarized antenna is smaller than the quarter wavelength corresponding to the low-band dual-polarized antenna; the low-band dual-polarized antenna is provided with several rectangular open slots at equal spacings, with symmetrical openings on both sides of the dipole, with a width of 1-1.5 mm and a length of 4-to 6 mm; and a ratio of the sum of widths of the open slots to a length of an arm of the dipole is greater than 0.16 and less than 0.24.

4 Claims, 11 Drawing Sheets

MULTI-BAND BASE STATION ANTENNA FOR SCATTERING SUPPRESSION

CROSS REFERENCE TO RELATED APPLICATION

This patent application claims the benefit and priority of Chinese Patent Application No. 202011263897.9 filed on Nov. 12, 2020, the disclosure of which is incorporated by reference herein in its entirety as part of the present application.

TECHNICAL FIELD

The present disclosure pertains to the technical field of antennas, and relates to a multi-band base station antenna for scattering suppression.

BACKGROUND ART

Over the past two decades, the growth of data traffic and the demand for mobility have promoted the unprecedented development of the mobile communications industry. The growing demand for wireless communications and sensing has caused a growing interest in multi-band antennas that support different services at the same time. Arrays of different bands usually share a common ground plate and a radome, and elements of different bands are usually interleaved to save space. However, due to the scattering of signals in one band by antenna elements in another band, the close proximity of these elements may cause distortion of a radiation pattern. Since low-band (LB) antenna elements are generally larger than high-band (HB) antenna elements, suppressing the scattering of HB signals from the LB elements can significantly improve system performance. The traditional method is to use a metal baffle or a metal wall to suppress cross-band scattering. The shape, size, and position of the metal baffle are optimized through trials and errors to improve radiation performance at two bands. Some cross-band scattering is reduced, but this design method increases the complexity of the design, especially for an upcoming 5G multiple input multiple output (MIMO) system that includes a large number of antenna elements. In addition, some researchers have developed the mantle stealth technology to reduce the scattering in a multi-band array. This technology uses a patterned metasurface layer to cover an antenna and make the antenna invisible in a given band. However, a shape of a shielding cloak largely depends on the shape of the antenna. It is difficult to design a shielding cloak for antennas with asymmetric structures. In addition, the large size of the cloak further limits its implementation in a base station antenna system.

The existing methods for suppressing scattering in the multi-band base station antenna mostly eliminate the scattering through external conditions, for example, by adding a metal wall or a metal baffle between antenna elements, and optimizing the shape, size, and position of the metal baffle through constant trial-and-error adjustments, so as to improve the radiation performance at two bands. Alternatively, a shielding metasurface layer invisible to a specified band is placed above the array elements to make the antenna invisible in the specified band, so as to achieve the ability to suppress the scattering. These design methods have their commonalities, that is, improving radiation performance of different bands by adding external conditions. Therefore, although some effects can be achieved, these design methods increase the difficulty and size of the antenna processing, and cannot be widely promoted in the face of the future 5G MIMO system.

Therefore, there is an urgent need for a new design method to suppress the scattering in a multi-band base station antenna array.

SUMMARY

In view of the above-mentioned defects, the present disclosure redesigns an antenna structure to internally eliminate the cross-band scattering in nature, instead of eliminating the scattering problem in a multi-band base station antenna by adding external conditions. A technical solution of the present disclosure is as follows.

A multi-band base station antenna for scattering suppression includes a high-band dual-polarized antenna and a low-band dual-polarized antenna, in which an operating band of the high-band dual-polarized antenna is 1.7-3.0 GHz, and four high-band dual-polarized antennas are disposed; an operating band of the low-band dual-polarized antenna operates is 0.69-0.96 GHz, and is comprised of two crossed dipoles; above the high-band dual-polarized antennas, a distance between the high-band dual-polarized antenna and the low-band dual-polarized antenna is smaller than a quarter wavelength corresponding to the low-band dual-polarized antenna; the low-band dual-polarized antenna is provided with several open slots at equal spacings, with symmetrical openings on both sides of the dipole; the open slots are rectangular-shaped, with a width of 1-1.5 mm and a length of 4-6 mm; and a ratio of the sum of widths of the open slots to a length of an arm of the dipole is greater than 0.16 and less than 0.24.

Preferably, a ratio of the spacing between the several open slots to the length of an arm of the dipole is greater than 0.048.

Preferably, the shape of the high-band dual-polarized antenna is rectangular-shaped.

Preferably, the shape of the low-band dual-polarized antenna is rectangular-shaped.

Compared with the prior art, the present disclosure improves a structure of a low-band dual-polarized antenna in a multi-band base station antenna array by making slots in the arm of the dipole of the low-band dual-polarized antenna, and retaining a slender metal patch therebetween for connection. This reduces a moving distance of high-frequency currents, so that high-frequency signals flow along the dipole arms to both sides without forming directional radiation, thereby reducing the scattering effect of the high-frequency signals on the low-band dual-polarized antenna on the high-band dual-polarized antenna. Meanwhile, the retained metal patches constitute a bridge for low-frequency currents. Therefore, although the low-band dual-polarized antenna has been slotted, an equivalent length of the low-band dual-polarized antenna at a low-frequency end has not changed, and the high-frequency currents are greatly suppressed. This design method essentially prevents the generation of the scattering problem, and the results have been proved by simulation.

To eliminate the scattering problem with the multi-band base station antenna array, the present disclosure does not adopt methods relying on external conditions, such as adding a metal wall or a shielding cover, but redesigns the structure of the low-band dual-polarized antenna in the multi-band base station array by making slots at both sides of the arm of dipole and retaining a metal patch therebetween for connection. Such a simple design not only suppresses the directional flow of high-frequency currents on the low-band dual-polarized antenna to prevent the high-frequency currents from damaging an original directional pattern of the high-band dual-polarized antenna, but also retains an original radiation pattern of the low-band dual-polarized antenna. The structure is simple and easy to process.

BRIEF DESCRIPTION OF THE DRAWINGS

FIG. 7(*b*) are directional patterns at 2.5 GHz and 3.0 GHz when a high-band dual-polarized antenna coexists with a low-band dual-polarized antenna without open slots in the prior art.

FIG. 7(*c*) are directional patterns at 2.5 GHz and 3.0 GHz when a high-band dual-polarized antenna coexists with a low-band dual-polarized antenna with open slots on the radiation arm both in a multi-band base station antenna for scattering suppression of an embodiment of the present disclosure.

FIG. 8(*b*) is a radiation pattern when a low-band dual-polarized antenna without open slots is fed separately in the prior art.

DETAILED DESCRIPTION OF THE EMBODIMENTS

Figure 1:
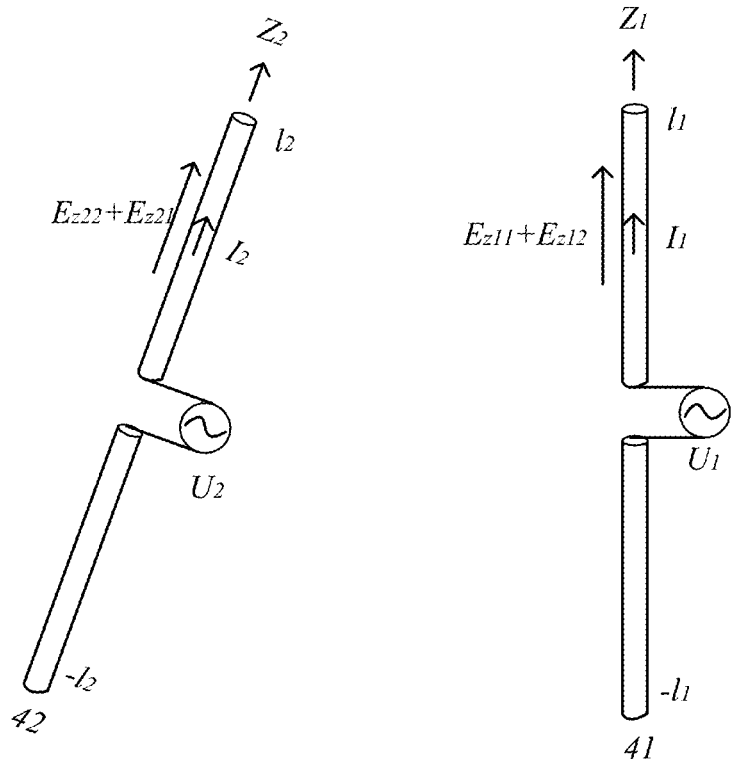
FIG. 1 is a schematic diagram of a binary coupled dipole antenna.
Figure 2:
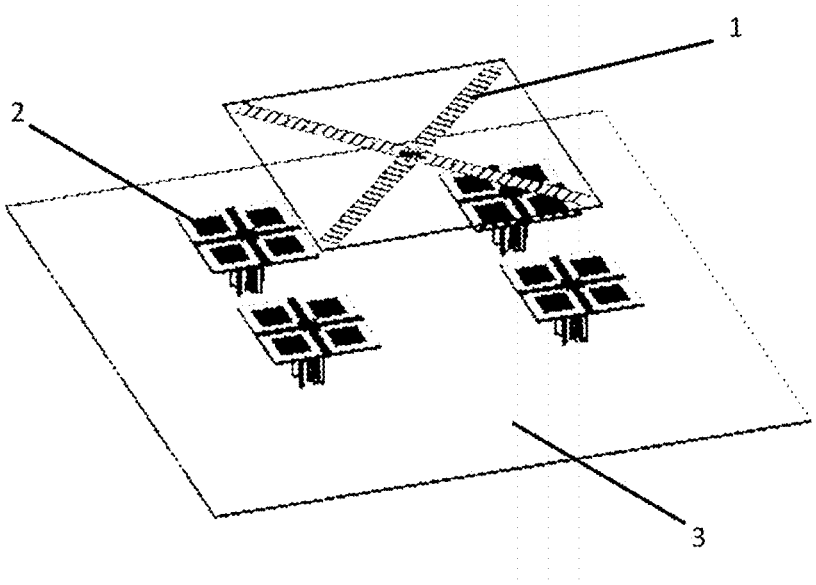
FIG. 2 is a schematic structural diagram of a multi-band base station antenna in the prior art.

To make the objectives, technical solutions, and advantages of the present disclosure clearer, the following further describes the present disclosure in detail with reference to the accompanying drawings and embodiments. It should be understood that the specific embodiments described herein are merely intended to illustrate the present disclosure but not intended to limit the present disclosure.

Instead, the present disclosure covers any substitutions, modifications, equivalent methods, and solutions defined by the claims in the spirit and scope of the present disclosure. Further, for enabling the public to have a better understanding of the present disclosure, some specific details are explained in detail in the following detailed description of the present invention. Those skilled in the art can fully understand the present disclosure without the description of these details.

MEANING OF REFERENCE NUMERALS IN THE FIGURES

1: low-band dual-polarized antenna (LB),

2: high-band dual-polarized antenna (HB);

3: ground, 41: dipole antenna 1, 42: dipole antenna 2, l1: length of dipole antenna 1, l2: length of dipole antenna 2, I1: current on dipole antenna 1, I2: current on dipole antenna 2, Ez11: electric field of dipole 1, Ez12: electric field generated by dipole 2 to dipole 1, Ez22: electric field of dipole 2, Ez21: electric field generated by dipole 1 to dipole 2, U1: voltage source of dipole 1, and U2: voltage source of dipole 2.

Referring to FIG. 1, there is shown a schematic diagram of a binary coupled dipole antenna, in which strong electromagnetic coupling occurs between the antennas that are close to each other. Electromagnetic fields around the antennas change, and the current, radiated power and input power on each antenna will also change. When the dipole 1 (that is, a dipole antenna 1-41) exists alone, it generates a current $I_1$ under the excitation of a power source, and establishes an electromagnetic field that satisfies its own boundary conditions, letting a tangential electric field on a surface of the dipole 1 being denoted as $E_{z11}$. A dipole 2 (that is, a dipole antenna 2-42) is placed near the dipole 1. In this case, a current on the dipole 2 generates a tangential electric field $E_{z12}$ on the surface of the dipole 1. Then a total tangential electric field on the surface of the dipole 1 is $E_{z1}=E_{z11}+E_{Z12}$. Under the effect of the dipole 2, a total radiated power of the dipole 1 is $$\begin{aligned} P_r &= -\frac{1}{2}\int_{-l_1}^{l_1} E_{Z1} I_1^* dz_1 \\ &= -\frac{1}{2}\int_{-l_1}^{l_1} (E_{z11} + E_{Z12}) I_1^* dz_1 \\ &= P_{11} + P_{12} \end{aligned} \tag{1}$$

In the formula, $$P_{11} = -\frac{1}{2}\int_{-l_1}^{l_1} E_{Z11} I_1^* dz_1, \tag{2}$$

$$P_{12} = -\frac{1}{2}\int_{-l_1}^{l_1} E_{Z12} I_1^* dz_1., \tag{3}$$

Where $I_1$* represents conjugate numbers of the current $I_1$, that is, two complex numbers with the same real parts and opposite imaginary parts; z1 is a very small length truncation on the dipole 1;

$P_{11}$ is a radiated power when the dipole 1 exists alone, which becomes a self-radiated power; and $P_{12}$ is a power generated by an induced electromotive force $[-E_{z12}d_{z1}]$ on the dipole 1 under the effect of the dipole 2, which becomes an induced radiation power.

A total radiated power of the dipole 2 under the effect of the dipole 1 can be obtained in the same way:

$$P_{r2}=P_{21}+P_{22} \tag{4}$$

In the formula, $$P_{21} = -\frac{1}{2}\int_{-l_2}^{l_2} E_{Z21} I_2^* dz_2 \tag{5}$$

$$P_{22} = -\frac{1}{2}\int_{-l_2}^{l_2} E_{Z22} I_2^* dz_2 \tag{6}$$

Where $I_2$* represents conjugate numbers of the current $I_2$, that is, two complex numbers with the same real parts and opposite imaginary parts; z2 is a very small length truncation on the dipole 2;

$P_{22}$ is a self-radiated power when the dipole 2 exists alone; and $P_{21}$ is an induced radiation power generated by an induced electromotive force $[-E_{z21}d_{z2}]$ on the dipole 2 under the effect of the dipole 1.

Letting the antinode values of currents on the dipoles 1 and 2 are respectively $I_{1m}$ and $I_{2m}$ which can be obtained by formulas (1) and (4):

$$\frac{2P_{r1}}{|I_{1m}^2|} = \frac{2P_{11}}{|I_{1m}|^2} + \frac{2P_{12}}{|I_{1m}|^2} \tag{7}$$

$$\frac{2P_{r2}}{|I_{2m}^2|} = \frac{2P_{21}}{|I_{2m}|^2} + \frac{2P_{22}}{|I_{2m}|^2} \tag{8}$$

and then $$Z_{r1} = Z_{11} + \frac{I_{2m}}{I_{1m}} Z_{12} \tag{9}$$

$$Z_{r1} = Z_{11} + \frac{I_{2m}}{I_{1m}} Z_{12} \tag{10}$$

In the formulas, $P_{r1}$ is the total radiated power of the dipole 1;

$P_{r2}$ is the total radiated power of the dipole 2;

$$Z_{r1} = \frac{2P_{r1}}{|I_{1m}|^2}$$

is a total radiation impedance of the dipole 1;

$$Z_{r2} = \frac{2P_{r2}}{|I_{2m}|^2}$$

is a total radiation impedance of the dipole 2;

$$Z_{11} = \frac{2P_{11}}{|I_{1m^2}|}$$

is a self impedance when the dipole 1 exists alone;

$$Z_{12} = \frac{2P_{12}}{I_{1m}^* I_{2m}}$$

is a mutual impedance induced by the dipole 2 to the dipole 1;

$$Z_{22} = \frac{2P_{22}}{|I_{2m}|^2}$$

is a self impedance when the dipole 2 exists alone;

$$Z_{21} = \frac{2P_{21}}{I_{2m}^* I_{1m}}$$

is a mutual impedance induced by the dipole 1 to the dipole 2; and it is derived that $Z_{12}=Z_{21}$, according to the reciprocity theorem.

From $$Z_{21} = \frac{2P_{21}}{I_{2m}^* I_{1m}} \text{ and } P_{21} = -\frac{1}{2}\int_{-l_2}^{l_2} E_{Z21} I_2^* dz_2,$$

it can be known that when a length $L_2$ of the dipole 2 decreases, $P_{21}$ decreases, and the mutual impedance $Z_{12}$ induced by the dipole 1 to the dipole 2 decreases. At the same time, due to the reciprocity theorem, the mutual impedance $Z_{12}$ induced by the dipole 2 to the dipole 1 also decreases. Therefore, mutual impedance between array elements can be effectively reduced by reducing the dipole length of one of the antennas, thereby reducing the coupling effect between different elements. However, the length of the antenna is closely related to the operating band of the antenna. If the length is arbitrarily reduced, a resonant frequency point of the antenna may shift to a low frequency zone, which is undesirable. Therefore, how to reduce the coupling effect between the elements while keeping the operating band unchanged has become a challenging task in the design, which is exactly the most significant innovation of this design.

A multi-band base station antenna for scattering suppression according to the present disclosure includes a high-band dual-polarized antenna and a low-band dual-polarized antenna.

The operating band of the high-band dual-polarized antenna is 1.7-3.0 GHz, and four high-band dual-polarized antennas are disposed; the operating band of the low-band dual-polarized antenna 1 is 0.69-0.96 GHz, and is comprised of two intersected dipoles; above the high-band dual-polarized antenna 2, a spacing between the high-band dual-polarized antenna 2 and the low-band dual-polarized antenna 1 is smaller than the quarter wavelength corresponding to the low-band dual-polarized antenna 1. The low-band dual-polarized antenna 1 is provided with several open slots 11 at equal spacings, with symmetrical openings on both sides of the dipole; the open slots 11 are rectangular-shaped, with a width of 1-1.5 mm and a length of 4-6 mm; and a ratio of the sum of widths of the open slots 11 to a length of an arm of the dipole is greater than 0.16. In a specific embodiment, a ratio of the spacing between the open slots 11 to the length of the arm of the dipole is greater than 0.048. The shape of the high-band dual-polarized antenna 2 is fan-shaped or rectangular-shaped.

Figure 3:
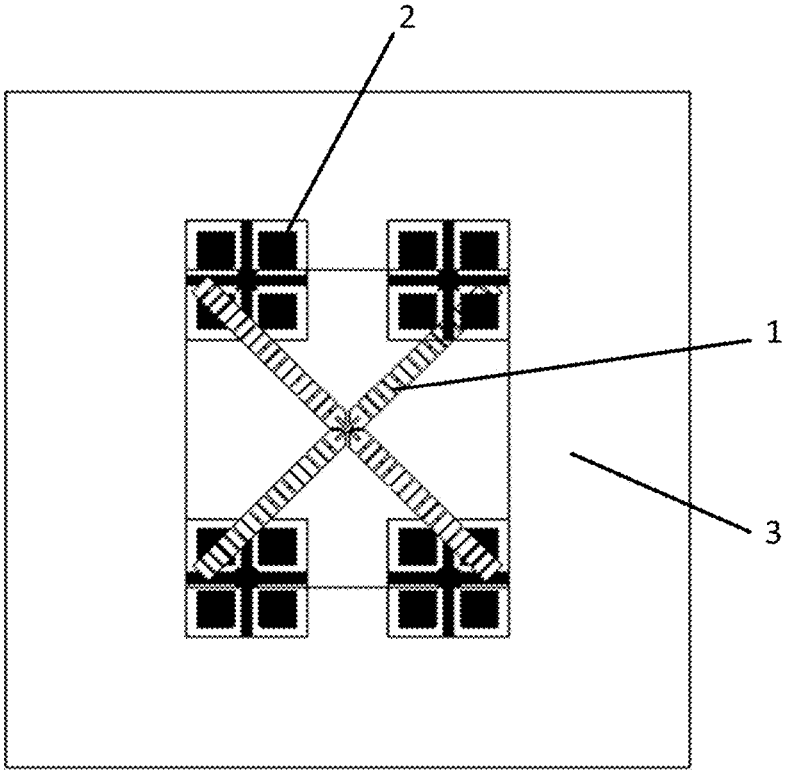
FIG. 3 is a schematic structural diagram of a multi-band base station antenna for scattering suppression according to an embodiment of the present disclosure.
Figure 4:
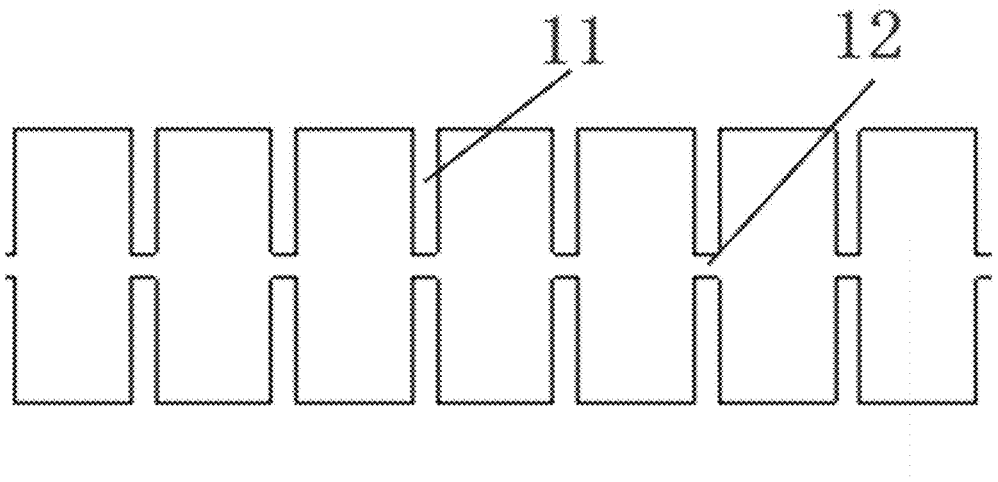
FIG. 4 is a schematic structural diagram of open slots of a multi-band base station antenna for scattering suppression according to an embodiment of the present disclosure.

The multi-band base station array element according to the present disclosure includes four high-band dual-polarized antennas 2 (HB2) with an operating band of 1.7-3.0 GHz and a low-band dual-polarized antenna 1 (LB1) with an operating band of 0.69-0.96 GHz. The operating bands cover operating bands of most 3G and 4G mobile communications systems. The LB1 is located between the four HB2s, and two HB2 columns form two HB2 sub-arrays that are fed simultaneously through a power divider. It can be seen from FIG. 3 that the LB1 and the HB2s overlap, and a spacing between them is very small and which can be 66 mm, much smaller than the quarter wavelength of 93.75 mm corresponding to LB1. Generally, whether there is scattering is determined by whether there is distortion in the HB2 simulation chart. In addition, the HB2s are overlaid with the LB1. When the HB2 is excited, an HB2 current is induced on the LB1, the HB2 current radiates an unwanted signal at high frequencies, and the scattered signal may cause serious distortion of a radiation pattern of the HB2. Therefore, how to suppress the HB2 current on the LB1 and reduce the coupling effect between the high-band antenna and the low-band antenna has become the key issue of this design.

Open slots 11 are made on both sides of the LB1. A single open slot 11 has a width of 1 mm and a length of 5 mm, a total width of the open slots 11 is 16 mm, a length of an arm of the dipole is 96.7 mm. The ratio of the total width of the open slots to the length of the dipole arm is greater than 0.16, which can produce an ideal effect. A short metal patch 12 is retained between the open slots for connection. The size of the metal patch 12 may be 1 mm long and 1 mm wide. Through the continuous (a spacing between the open slots 11 is 4.7 mm, and a ratio of the spacing to an overall length of the LB1 is greater than 0.048) slotting, a flow distance of high-frequency currents on the LB1 can be effectively reduced, and directional flow of induced high-frequency signals on the LB1 is reduced, so that high-frequency signals on the LB1 cannot form effective radiation, thereby reducing the scattering effect on the HB2. Meanwhile, the retained metal patches 12 allow low-frequency signals to pass through, keeping the operating band of the LB1 from shifting significantly. On the other hand, the length of the dipole can be slightly increased to make the resonant frequency points of the antenna return back to the desired operating band, which does not increase the shifting distance of the high-frequency signals on the LBT. In order to verify the scattering suppression effect of this design on the high-frequency HB2, profile of the high-frequency currents induced by the high-frequency signals on the LB1 is simulated when the HB2 is fed at 2.5 GHz. In addition, radiation patterns of the HB2 at the frequency points of different bands are simulated. For different frequency points, the directional patterns when the HB2 is excited separately, the directional patterns when no open slot is made on the LBT, and the directional patterns when open slots are made on the LB1 are simulated respectively. The results of this design are obtained by comparing these patterns with directional patterns obtained using different processing methods at different frequency points. Finally, the radiation patterns with and without open slots in the LB1s of the same length are also simulated.

Figure 5:
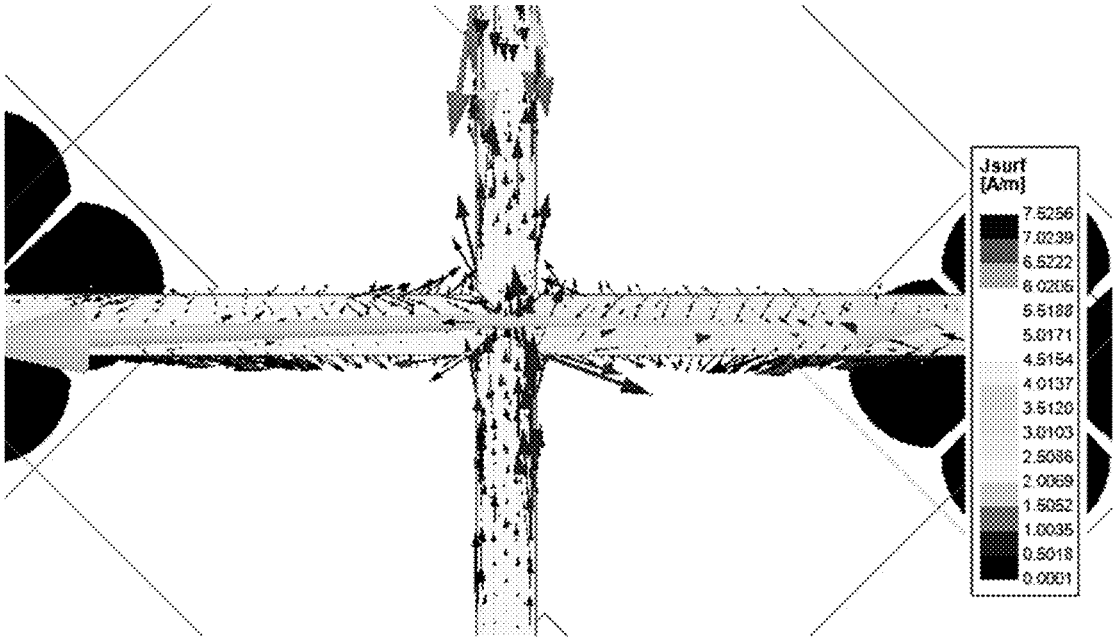
FIG. 5 is a high-frequency current profile of a multi-band base station antenna in the prior art.
Figure 6:
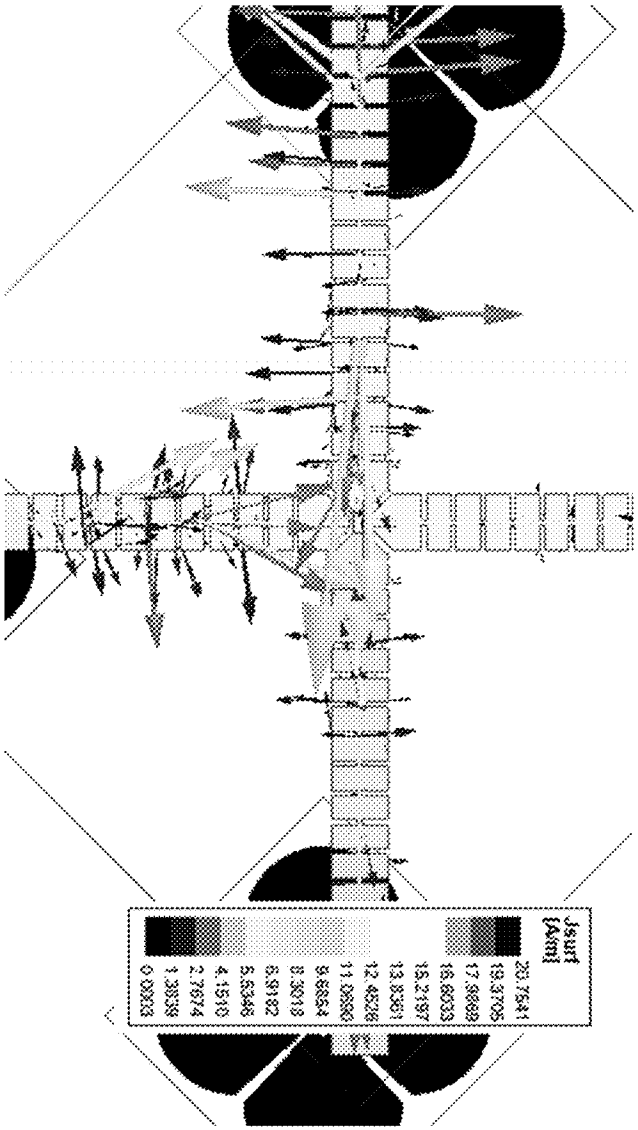
FIG. 6 is a high-frequency current profile of a multi-band base station antenna for scattering suppression according to an embodiment of the present disclosure.

Referring to FIG. 5 and FIG. 6, when the HB2 is excited, high-frequency currents are induced on the surface of the LB1 by high-frequency electromagnetic waves of the HB2. It can be seen from FIG. 5, when the dipole is not slotted, the high-frequency currents follow the orientated flow direction, which is the same as or opposite to a polarization direction of the low-frequency signals. Therefore, when superimposed with the high-frequency signals of the HB2, the radiation direction of the HB2 will be affected, and the original radiation pattern of the HB2 will be deteriorated. As shown in FIG. 6, when the LB1 is slotted, the induced high-frequency signals do not follow the orientated movement direction, and most of currents spread to both sides due to the open slots, so that no strong directional radiation is formed. When superimposed with the high-frequency signals of the HB2, induced high-frequency signals of the LB1 naturally have a little effect on the high-frequency signals of the HB2, and the stable radiation pattern of the HB2 is maintained.

Figure 7:
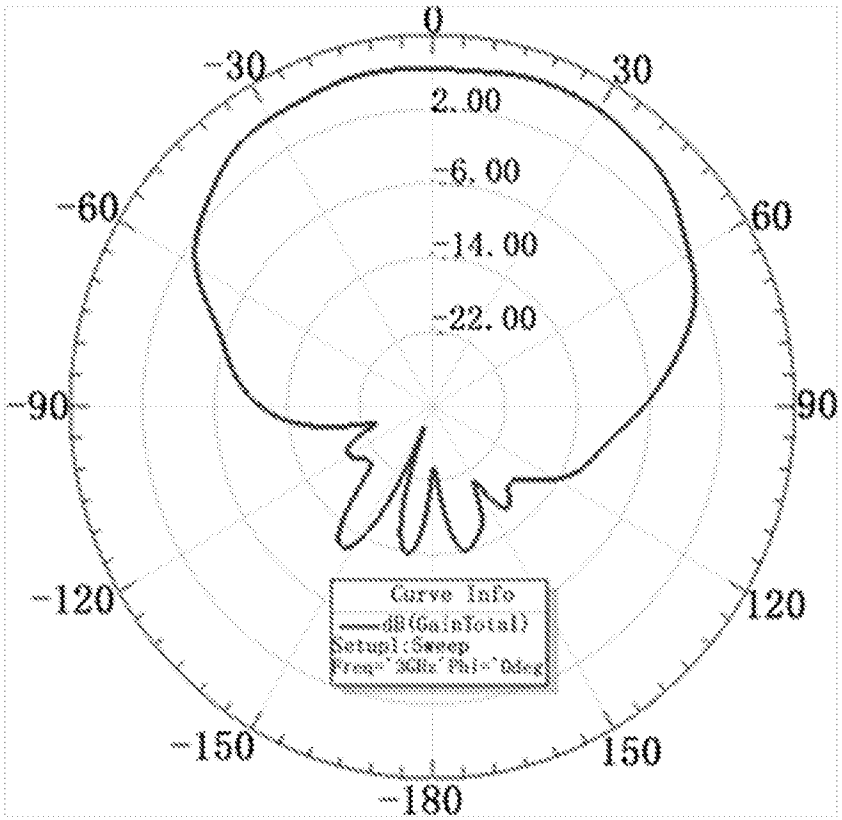
FIG. 7(*a*) are directional patterns at 2.5 GHz and 3.0 GHz when a high-band dual-polarized antenna is fed separately in the prior art.
Figure 7:
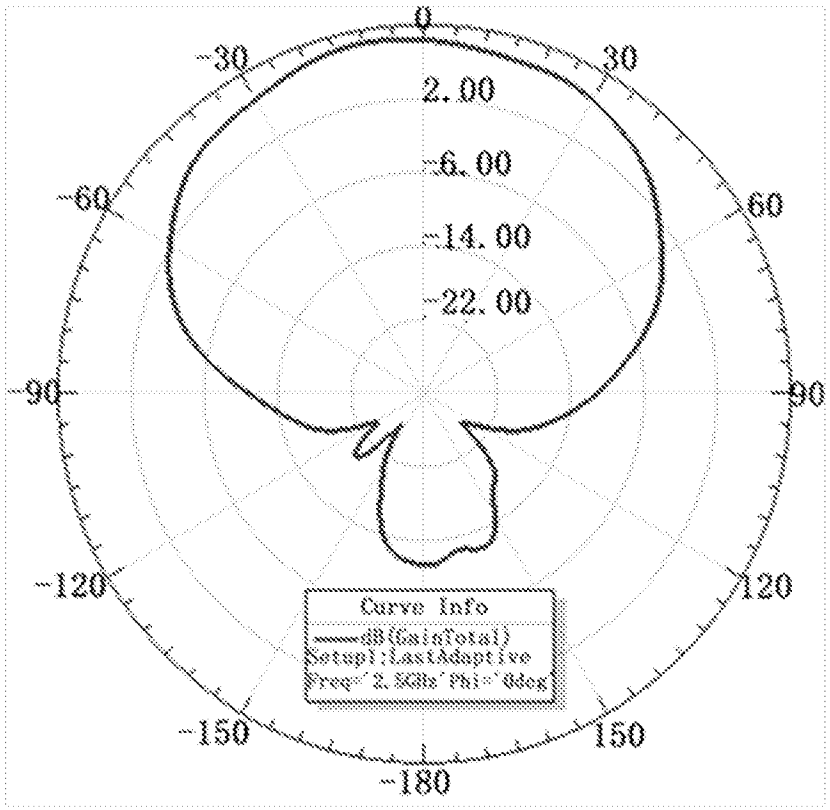
Figure 7:
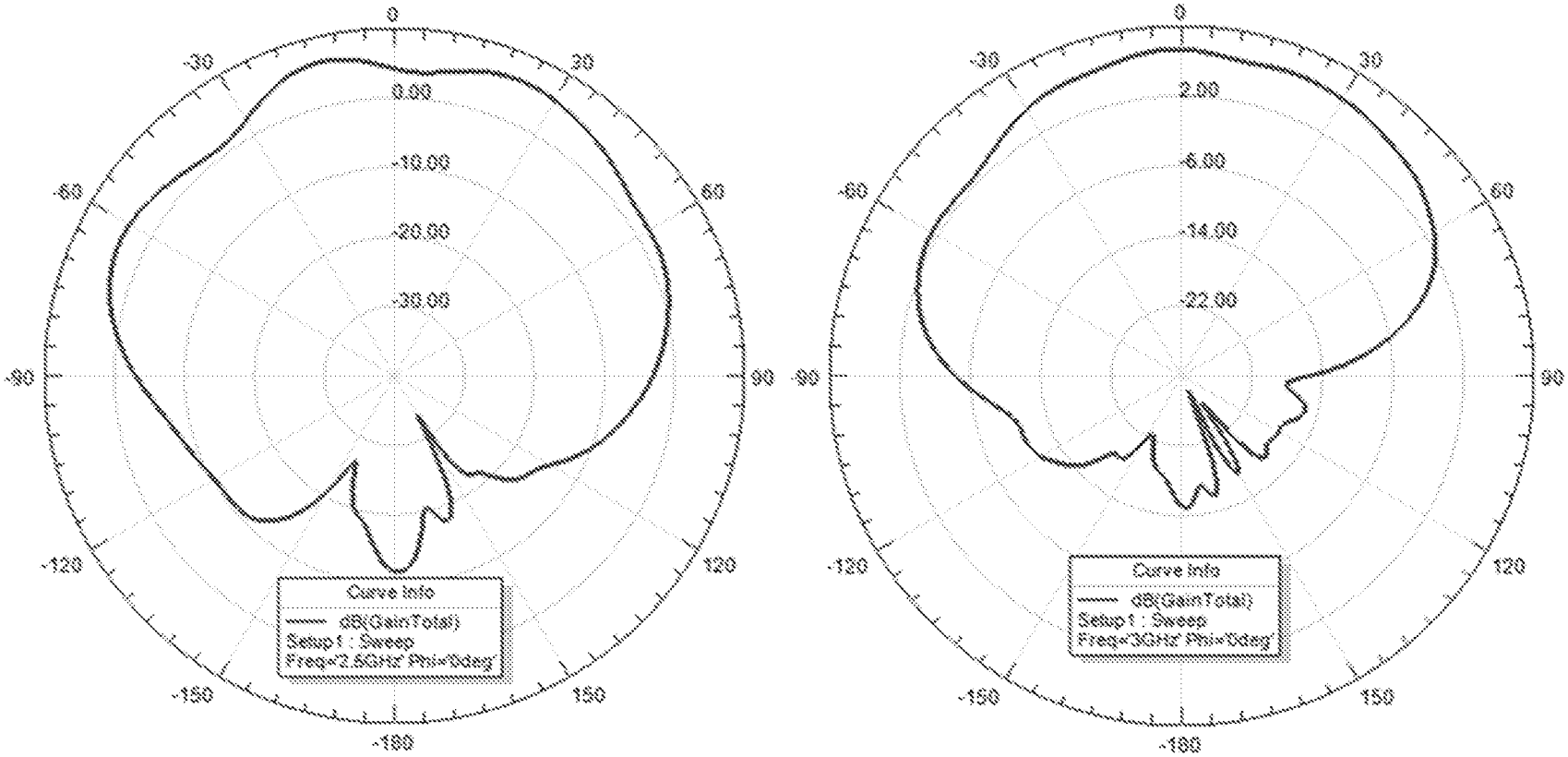
Figure 7:
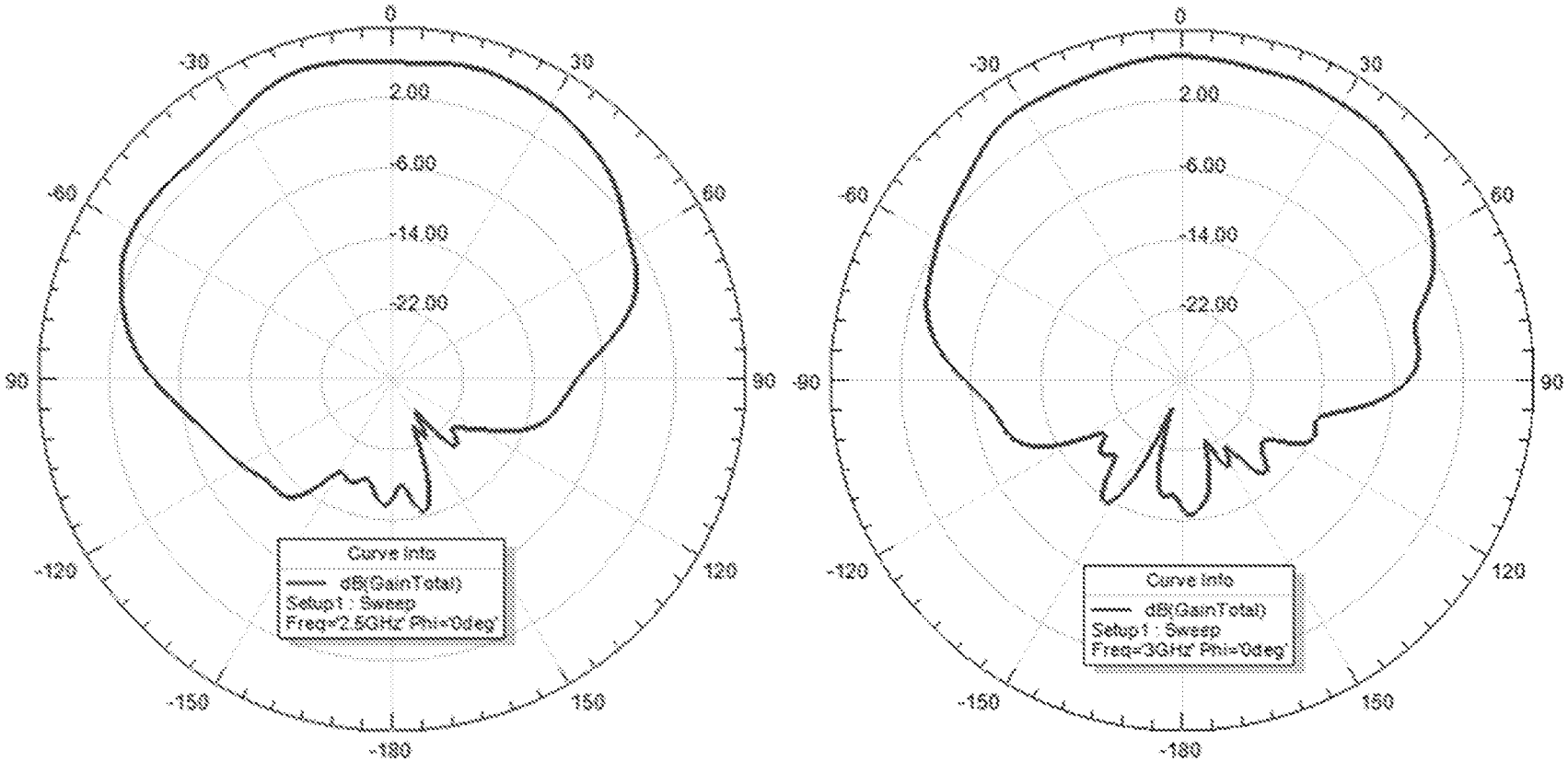

FIG. 7(*a*), 7(*b*), 7(*c*) respectively show the radiation patterns of the HB2 under different conditions from the LB1. Among them, directional patterns of two frequency points with operating frequency points of 2.5 GHz and 3.0 GHz are shown. FIG. 7(*a*) shows directional patterns at 2.5 GHz and 3.0 GHz when the HB2 is fed separately. FIG. 7(*b*) shows directional patterns at 2.5 GHz and 3.0 GHz when the HB2 coexists with the LB1 without open slots 11. FIG. 7(*c*) shows directional patterns at 2.5 GHz and 3.0 GHz when the HB2 coexists with the LB1 with open slots 11.

As seen from the directional patterns of the two different frequency points in FIG. 7(*b*), when the HB2 coexists with the LB1 without open slots 11, the upper parts of the radiation patterns are obviously different from the upper parts of the radiation patterns shown in FIG. 7(*a*), which means the high-frequency signals from the operating HB2 cause a high-frequency current on the LB1, and the current ultimately affects the original radiation pattern of the HB2.

As seen from the directional patterns of the two different frequency points in FIG. 7(*c*), when the HB2 coexists with the LB1 with open slots, the upper parts of the radiation patterns are basically similar to the upper parts of the radiation patterns shown in FIG. 7(*a*), and the slight distortion of the directional pattern is acceptable, or can be ameliorated by further model optimization. This means the high-frequency current caused to the LB1 by the high-frequency signals from the operating HB2 does not largely change the radiation direction of the HB2, and the scattering is well suppressed in the multi-band base station antenna array, which means slotting on the LB1 helps to reduce the mutual coupling between the LB1 and the HB2, thereby reducing the scattering effect.

Figure 8A:
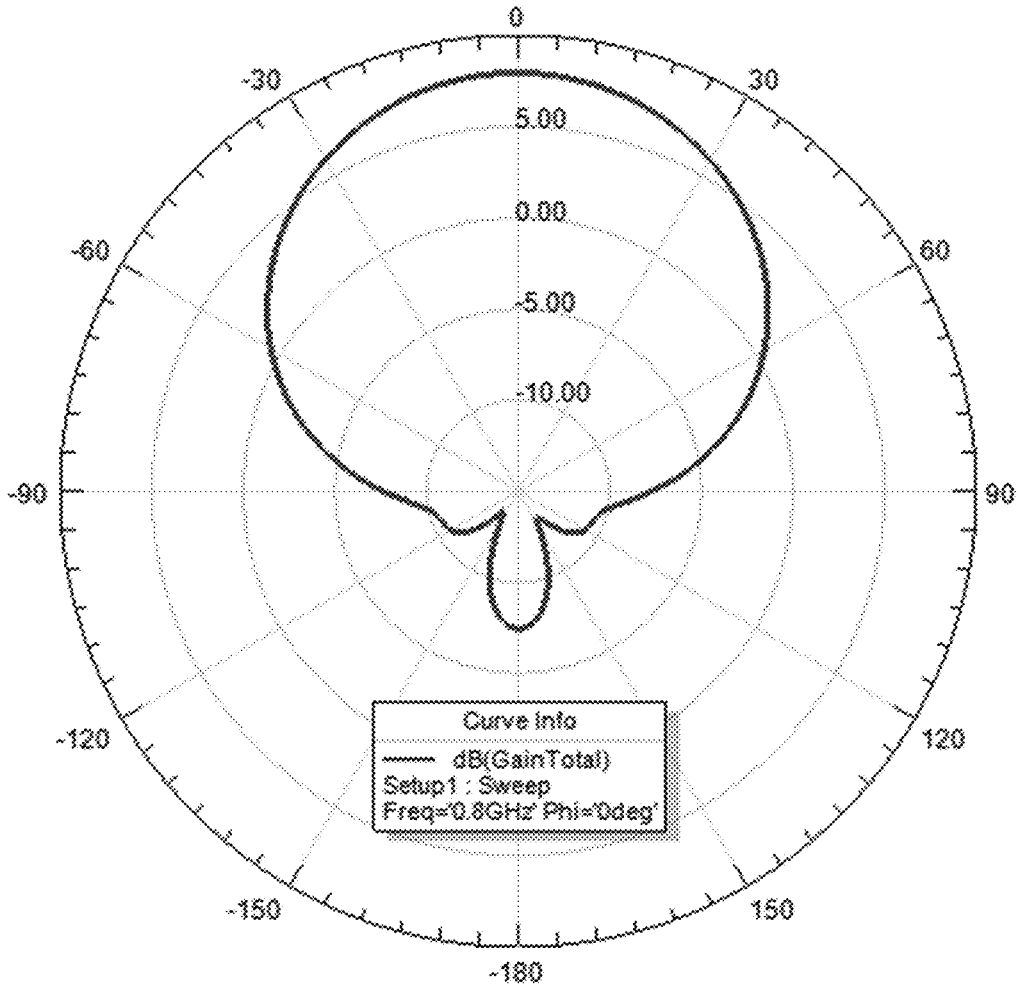
FIG. 8(*a*) is a radiation pattern when a low-band dual-polarized antenna with open slots is fed separately according to an embodiment of the present disclosure.
Figure 8B:
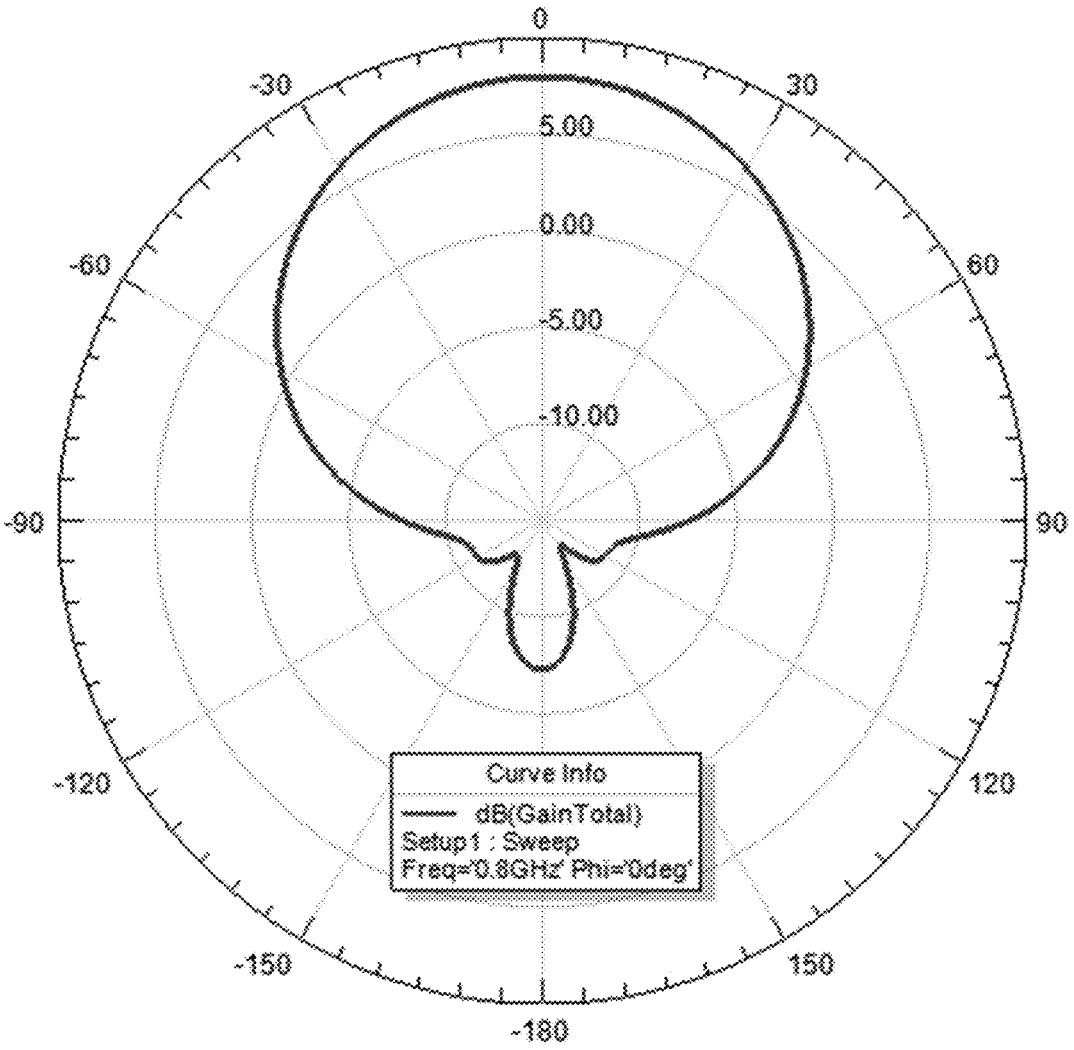

FIG. 8(*a*) and FIG. 8(*b*) are the radiation patterns with and without open slots 11 on the LB1s of the same length. As a result, it can be seen that the radiation patterns in the two cases are basically unchanged, and the operating frequency points do not significantly shift. This further proves that the operating frequency points do not significantly shift for the LB1 with and without open slots. At the same time, in the field of radio frequency, the slender metal patch 12 retained between the slots may be considered as short-circuited at low frequencies, or may be considered as open-circuited at high frequencies due to its enhanced inductance effect. Therefore, the high-frequency currents induced by the HB2 on the LB1 do not form the obvious directional currents as shown in FIG. 5, but spread to both sides, as shown in FIG. 6. The explanation is made from the perspective of designed structure.

In summary, slotting on the LB1 contributes to the scattering suppression in the multi-band base station antenna array, and at the same time, the designed structure is simple, the problem is eliminated essentially.

The above descriptions are merely preferred embodiments of the present disclosure, and are not intended to limit the present disclosure. Any modification, equivalent substitution and improvement without departing from the spirit and principle of the present disclosure shall be included within the protection scope of the present disclosure.

What is claimed is:

1. A multi-band base station antenna for scattering suppression, comprising a high-band dual-polarized antenna and a low-band dual-polarized antenna, wherein an operating band of the high-band dual-polarized antenna is 1.7-3.0 GHz, and four high-band dual-polarized antennas are disposed; an operating band of the low-band dual-polarized antenna operates is 0.69-0.96 GHz, and is comprised of two crossed dipoles; above the high-band dual-polarized antennas, a distance between the high-band dual-polarized antenna and the low-band dual-polarized antenna is smaller than a quarter wavelength corresponding to the low-band dual-polarized antenna; the low-band dual-polarized antenna is provided with several open slots at equal spacings, with symmetrical openings on both sides of the dipole; the open slots are rectangular-shaped, with a width of 1-1.5 mm and a length of 4-6 mm; and a ratio of the sum of widths of the open slots to a length of an arm of the dipole is greater than 0.16 and less than 0.24.

2. The multi-band base station antenna for scattering suppression according to claim 1, wherein a ratio of the spacing between the several open slots of the low-band dual-polarized antenna to the length of the arm of the dipole is greater than 0.048.

3. The multi-band base station antenna for scattering suppression according to claim 1, wherein the shape of the high-band dual-polarized antenna is rectangular-shaped.

4. The multi-band base station antenna for scattering suppression according to claim 1, wherein the shape of the low-band dual-polarized antenna is rectangular-shaped.

* * * * *